US008707485B1

(12) United States Patent
Conley

(10) Patent No.: US 8,707,485 B1
(45) Date of Patent: Apr. 29, 2014

(54) THERAPEUTIC SUPPORT PILLOW

(76) Inventor: Susan Conley, Acton, MA (US)

( * ) Notice: Subject to any disclaimer, the term of this patent is extended or adjusted under 35 U.S.C. 154(b) by 0 days.

(21) Appl. No.: 13/507,193

(22) Filed: Jun. 12, 2012

Related U.S. Application Data

(60) Provisional application No. 61/520,647, filed on Jun. 13, 2011.

(51) Int. Cl.
*A47G 9/10* (2006.01)

(52) U.S. Cl.
USPC ..... 5/636; 5/645; 5/490

(58) Field of Classification Search
USPC ..... 5/636, 645, 490, 950, 952
See application file for complete search history.

(56) References Cited

U.S. PATENT DOCUMENTS

| | | | | |
|---|---|---|---|---|
| 3,148,389 | A * | 9/1964 | Lustig | 5/645 |
| 3,400,413 | A | 9/1968 | LaGrossa | |
| 3,543,313 | A | 12/1970 | Schweigert | |
| 4,908,894 | A * | 3/1990 | Sanders | 5/645 |
| 5,168,590 | A | 12/1992 | O'Sullivan | |
| 5,363,524 | A | 11/1994 | Lang | |
| 5,367,731 | A | 11/1994 | O'Sullivan | |
| 5,708,998 | A | 1/1998 | Torbik | |
| 5,819,347 | A | 10/1998 | Masuda | |
| 6,910,237 | B2 | 6/2005 | DiGirolamo | |
| 6,931,682 | B2 | 8/2005 | Kruger, Jr. | |
| 6,988,286 | B2 | 1/2006 | Schecter et al. | |
| 7,089,617 | B1 | 8/2006 | Lauro | |
| 7,152,263 | B1 | 12/2006 | Delfs | |
| 7,346,947 | B2 | 3/2008 | Kruger, Jr. | |
| 7,788,750 | B2 | 9/2010 | Norstrem | |
| 7,832,034 | B2 | 11/2010 | Liu et al. | |
| 2006/0016011 | A1 | 1/2006 | Berg | |
| 2009/0205133 | A1 | 8/2009 | Thomas | |
| 2009/0211030 | A1 * | 8/2009 | Norstrem | 5/640 |
| 2010/0200001 | A1 | 8/2010 | Randall | |
| 2013/0167298 | A1 * | 7/2013 | Grunstein | 5/636 |
| 2013/0305457 | A1 * | 11/2013 | Grunstein | 5/636 |

FOREIGN PATENT DOCUMENTS

JP 2006136678 6/2006

OTHER PUBLICATIONS

Tri-Core Pillow Ad, www.coreproducts.com.
Pillow Relief Advertisement, (Tri-Core Pillow by Core Products Inc.), www.pillowrelief.com.
Sobakawa Cloud Pillow Information/Care Instructions, Oct. 16, 2009, Natures Pillows, Inc., Trevose, Pennsylvania.

* cited by examiner

*Primary Examiner* — Robert G Santos
(74) *Attorney, Agent, or Firm* — Joseph P. Aiena

(57) ABSTRACT

A therapeutic pillow is provided which allows for proper support of the spine and neck by supporting a proper range of cervical lordosis, while also giving increased comfort to the user. The pillow includes the combination of a firmer inner core and a second outer layer. The inner core area includes a central recessed area for the head and a curved neck area for spinal support while the second outer layer provides comfort to the sleeper/user. The outer cover is padded with options including down/feather fill or down alternative. The inner core insert of the pillow is made of poly-fill fiber and stuffed to a firm level for support. The inner core insert has two shape options, one for side sleepers and the other for back/side combination sleepers.

13 Claims, 15 Drawing Sheets

THERAPEUTIC SUPPORT PILLOW

CROSS REFERENCE TO RELATED APPLICATIONS

This application claims benefit of and priority to U.S. provisional application Ser. No. 61/520,647 filed on Jun. 13, 2011, incorporated herein by reference in its entirety.

FIELD

The present invention relates to a support pillow which provides proper alignment for the neck and spine.

BACKGROUND

Many individuals experience some form of back spasms or neck pain. Often this can be attributed to poor posture, strain on the neck from looking down at computers or from reading or poor neck and spine alignments from sleeping. There are many pillows on the market and many are advertised as support pillows. However, many of these pillows suffer from the drawbacks that the pillows are too hard and too firm which makes it uncomfortable while sleeping. On the other hand, if the pillow is foam, then many people feel they are too warm or too hot and the pillow also becomes hard over time as the foam loses any elasticity. Additionally, foam materials may also release gases and therefore may emit toxins. Consumers may purchase numerous pillows in an attempt to find a support pillow which has the correct comfort, i.e. the pillow that feels "just right." There is a desire for a support pillow which has the feel of an individual's favorite down pillow, but would be supportive as well so that they can sleep with more comfort in their neck and cervical spine.

SUMMARY

The present invention overcomes the problems discussed above with a novel design which maximizes comfort of the user while also providing proper neck and spine support.

The pillow of the present invention combines an inner core insert piece and an outer cover. In this manner, the present invention also combines the properties of two distinctly different materials, one that gives support to the neck while the other offers comfort to the face, neck, head and ears. By using down or down alternative as an outer layer on the pillow, it disguises the support that is inherent underneath the soft outer layer. This support comes from a firmer inner core insert which is designed for the curve of the human neck.

The human cervical spine, or neck, normally has a lordotic curve which is to be supported by the shape of the pillow of the present invention. Pillow designs for the back and side combination sleeper are included herein. The pillow of the present invention has a curved shape that the neck rests upon and then a central depression where the back of the head rests and is on the same plane as the shoulders and the rest of the body. This effectively keeps the neck in proper alignment when an individual sleeps on their back. The design for the side sleeper is supportive to the neck by the thickness of the pillow. When side sleeping, it is important to keep the head, neck and cervical spine in alignment with the rest of the spine, so that it neither tilts upward nor downward. With the present invention, the approximate six inch thickness of the supportive pillow keeps the head of most people in the right position when side sleeping, and yet remains soft on their face or ear due to the down layer on the exterior.

The pillow of the present invention provides proper support for the spine and neck while also having increased comfort to the user. A feature is the combination of two types of materials, one firmer inner core to provide support to the spine and a second outer layer to create a superior level of comfort for the sleeper/user. The outer cover is padded with one of two options—either down/feather fill or down alternative. The inner core insert is made of a polyester fill fiber (such as Poly-Fil®, made by Fairfield Processing Corp., Danbury, Conn.) and stuffed to a somewhat firm level for support. The inner core insert may come in two shape options, one for side sleepers and the other for back/side combination sleepers.

The pillow of the present invention provides advantages such as relief from tension and spasms, relief from some headaches, helps increase restful slumber and helps restore the normal curve/lordosis of the neck which is reduced or diminished in many people due to excessive time at a computer, reading books, looking downward or generally poor posture.

In brief, the present invention includes an inner core for a pillow, with the inner core comprising a top surface section with outer edges and an interior area and a bottom surface section with outer edges and an interior area. The top surface outer edges are fastened to the bottom surface outer edges to form a pocket which is later filled or substantially filled with a polyester fiber fill material (e.g. Poly-File). The top surface section and the bottom surface section are fastened together at the interior areas, thereby forming a depressed area with a surface for receiving an individual's head when they lie on the pillow. When the fill material is placed into the volume of the pocket, it is excluded or substantially excluded from the depressed area as the top and bottom surface sections are fastened together in this area. Walls then extend upward from the depressed area to the outer edges of the top surface, thereby forming at least one curved neck support area on the top surface. The curved neck support area has a curvature which provides support to the neck and provides a lordosis curvature of 35 to 45 degrees to the individual.

When an inner core of the present invention is inserted into an outer casing, the inner core and casing combine to form the support pillow of the present invention. The outer pillow casing has first and second pockets for receiving fill material, such as down or down alternative, with the first and second pockets fastened together to form an interior opening to receive the inner core. The inner core includes a top surface section with outer edges and an interior area as well as a bottom surface section with outer edges and an interior area. The top surface outer edges are fastened to the bottom surface outer edges to form a pocket. This pocket is filled or substantially filled with a polyester fiber fill material for support. The top surface section and the bottom surface section are also fastened together at a portion of their interior areas which creates a depressed area which includes a flexible surface for receiving an individual's head as the individual lies down and places their head on the pillow for the back sleeper. Again, when the fill material is placed into the volume of the pocket, it is excluded or substantially excluded from the depressed area where the top and bottom surface have been fastened together. Walls extend upward from the depressed area to the outer edges of the top surface, thereby forming curved neck support areas on the top surface. The curved neck support areas have a curvature which supports the lordosis curvature of 35 to 45 degrees to the individual's cervical spine. By combining this firmer curved support with the soft down fill in the pockets of the outer pillow casing, it allows for the user to have maximum comfort.

BRIEF DESCRIPTION OF THE DRAWINGS

The accompanying drawings illustrate various embodiments of the present invention and system and are a part of the specification. The illustrated embodiments are merely examples of the present invention and do not limit the scope thereof.

DETAILED DESCRIPTION

The present invention will be described now with respect to the accompanying figures.

Figure 1:
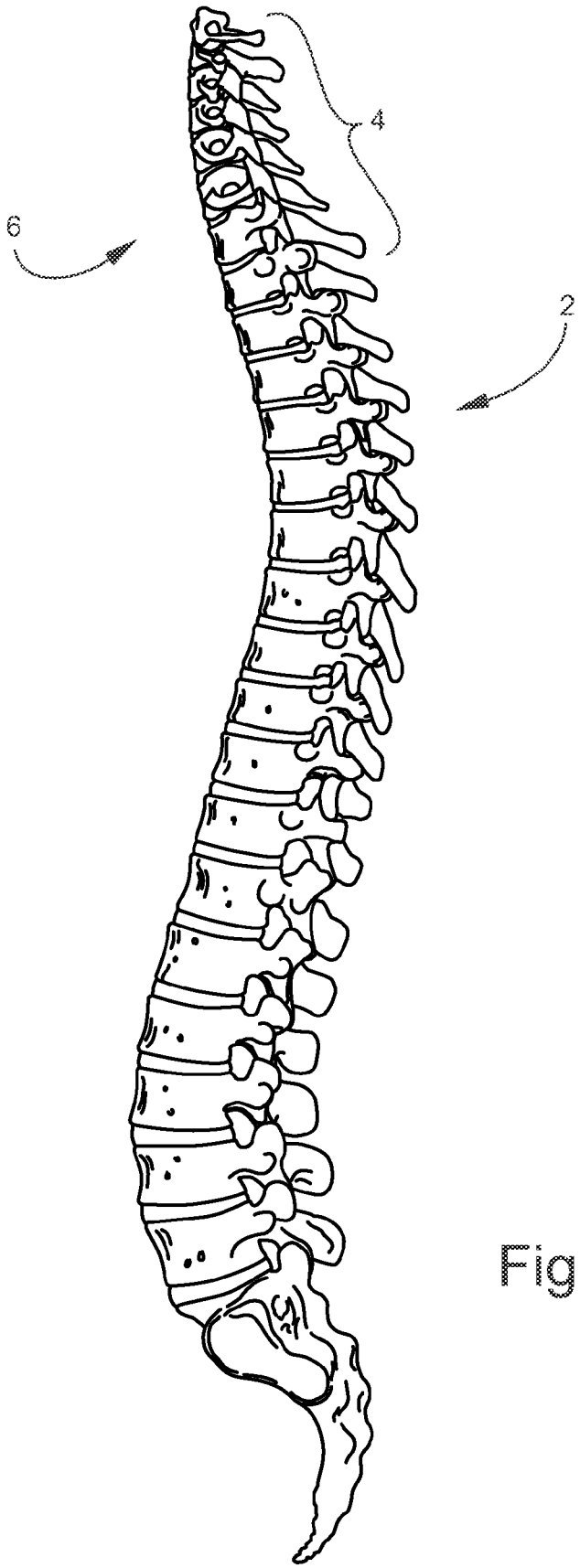
FIG. 1 is a schematic illustration of a lateral view of the human spine.

Referring to FIG. 1 there is shown a lateral view of the human spine 2. The neck, or cervical spine 4, is composed of seven vertebra, they are the first seven segments of the spinal column 2. This region of the spine 2 has what is called a Lordosis 6, a normal curvature of the spine that is formed as a secondary curve in development as a baby when the head is lifted while prone on the abdomen or when beginning to crawl. A lordotic curvature 6 is one that is convex anteriorly. This is important biomechanically for proper weight bearing of the head and neck, and people who have had a reduced curve usually have neck pain, according to research statistics. Maintenance of this curvature 6, or improvement of the curve is often a goal in care/treatment plans. The ability to support this curve 6 during the night of sleep is essential for everyone, but most especially for those with painful neck conditions.

Figure 2:
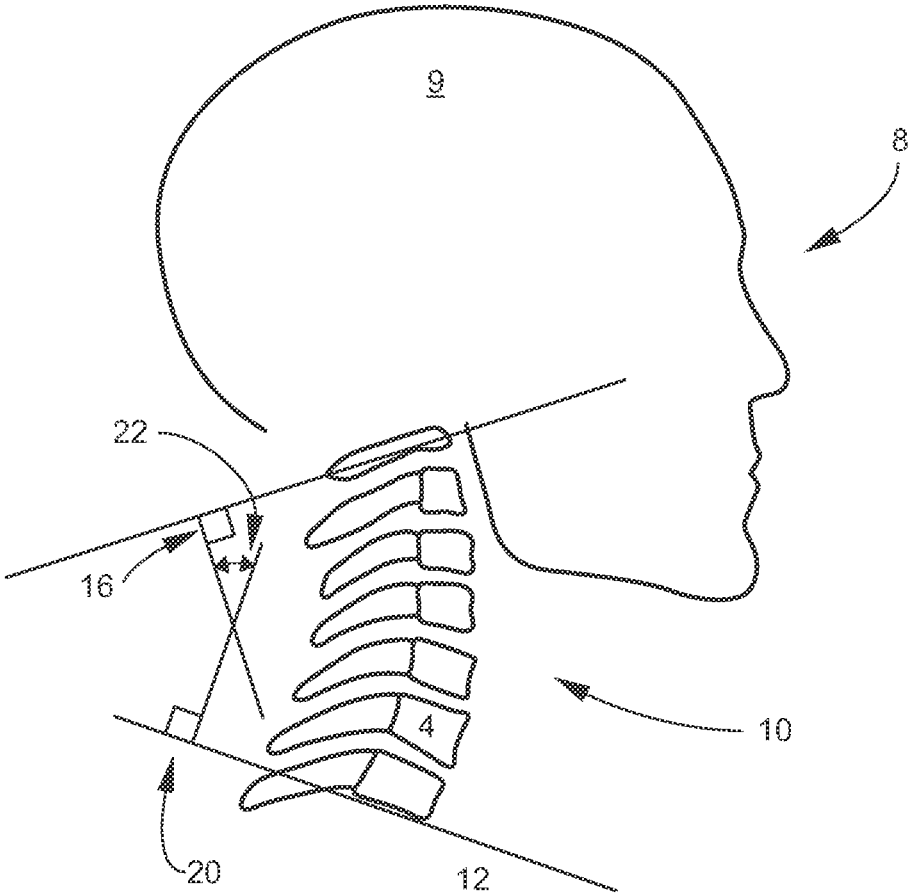
FIG. 2 is an illustration of the cervical curvature of the neck.

As shown in FIG. 2, there is disclosed a diagram to indicate the angle of cervical curvature of an average human 8. Generally shown is the head 9 of a human 8, along with the neck 10 and shoulders 12. Internal to the neck 10, is shown the cervical spine 14. The angle of cervical curvature is noted by reference numeral 22, and is determined by the intersection of right angle 16 and right angle 20.

FIG. 2 is similar to how the spine and neck would appear on a radiology image and the angle 22 is measuring the curve/lordosis 6 in the cervical spine 4, which has a normal range of 35-45 degrees, with 40 being average. The measurements for normal values of lordosis are shown below with respect to Table 1. FIG. 2 shows that normally a neck has this curve 6 and it can be precisely measured via radiograph and is important for health, alignment and posture. Many people have lost their curve 6 either fully or partially, and some have even reversed it. This leads to various issues, such as spasms, tension, sleeping problems, neck pain, and even headaches.

In analyzing the angle of cervical curvature, the position of the head is an important factor in determining the lordosis 6. If the chin is lowered, tucked downward, or retracted, the effect is to straighten the lordosis 6.

TABLE 1

Normal Values of the Cervical Lordosis

| Method | Average | Minimum | Maximum |
|---|---|---|---|
| Depth (mm) | 12 | 7 | 17 |
| Jochumsen (mm) | 3-8 | 1 | 9 |
| Angle (deg) | 40 | 35 | 45 |
| Drexler (deg) | 40 | 16 | 60 |

Yochum, Terry R. and Rowe, Lindsay J., *Essentials of Skeletal Radiology*, Vol. 1, J. W. Pine, Jr., Editor, Ch. 3, "Measurements in Skeletal Radiology," p. 181, (1987). (Note: FIG. 2 of the present invention is a schematic representation of FIG. 3.19C from the citation of the above reference).

The pillow of the present invention is designed to support the lordosis 6 within a normal range of 35-45 degrees. As shown, in FIG. 3A, the pillow 24 of the present invention comprises an inner core section 26 and a softer cover section 28 filled with a cushion-like or soft material, such as down/down feather fill, down alternative fiber, down alternative webbing/netting, or combinations thereof, or other suitable alternatives in the art. The fabric used for the inner core section 26 and softer cover section 28 may be an organic cotton fabric or other alternatives in the art. The inner core section 26 is firmer relative to the cover section 28. The shape and design of the pillow 24, and particularly the inner core section 26, keeps the neck and head in the best possible alignment while sleeping. The two types of sleepers best suited for use with the pillow 24 of the present invention are: a.) the back/back and side combination sleeper, and b.) the side sleeper. The pillow 24 of the present invention is described below with reference to each of these types of sleepers.

Figure 4:
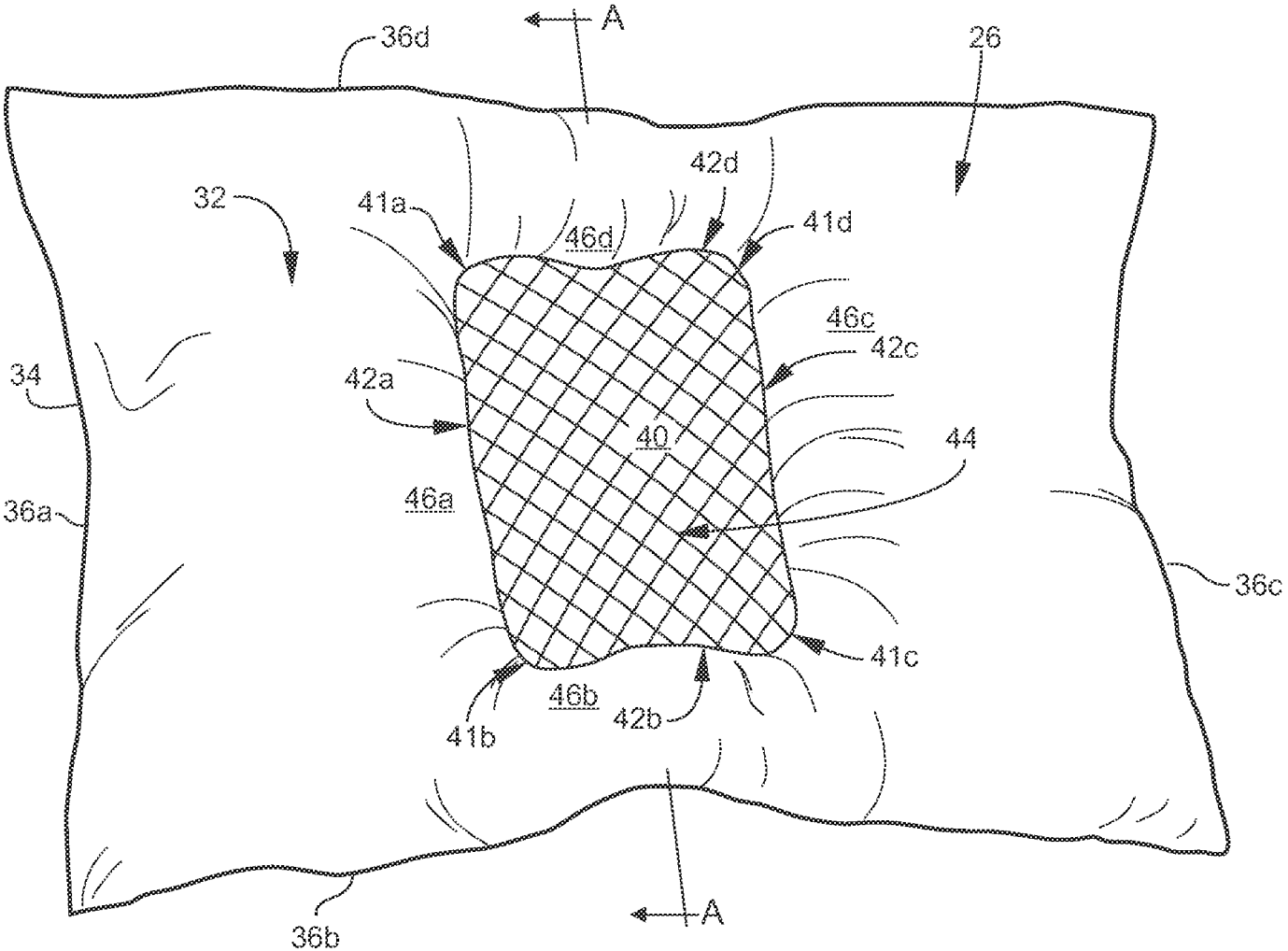
FIG. 4 is the inner core of the pillow of the present invention.

Referring to FIG. 4, there is shown the inner core 26 for support pillow 24 of the present invention for a back sleeper. The inner core 26 for support pillow 24 has a top surface 32, a bottom surface 34, and with edges 36 (36*a*-36*d*). The top surface 32 and the bottom surface 34 meet along edges 36 and thereby create a pocket 38 (FIG. 5) in between top and bottom surfaces 32, 34 which is filled with support material. Within an interior area of surface 32 or 34 of the inner core 26 of pillow 24 there is a central depression 40. The central depression 40 is defined by edges 42 (noted individually as 42*a*, 42*b*, 42*c*, and 42*d*) which are shown in top surface 32 of inner core 26 for pillow 30. Further, the central depression 40 includes slightly rounded corners 41*a*-41*d* to reduce tension in the fabric material. The central depression 40 is similarly on the bottom surface 34 of the inner core 26, thereby making the core 26 and pillow 30 reversible once the core is placed inside the case.

The central depression area includes a surface area 44 (indicated by cross hatching) for resting the head 9 of an individual 8. This central depression 40 is below the remainder of inner core 26 of pillow 28 providing curvature to top surface 32 between corresponding edge areas, with upwardly extending curved walls 46*a*-46*d* from the central edges (42*a*-42*d*). For example, top surface 32 is curved between edge 42*a* of central depression 40 over curved wall 46*a* to corresponding edge 36*a* of inner core 26. Similarly, the central depression 40 creates curvature on top surface 32 between edge 42*b* of the depression 40, up and over curved wall 46*b* and edge 36*b* of inner core 26. Likewise, the top surface 32 is also curved due to depression 40 and depressed area 44 between depression edges 42*c*, up and over curved wall 46*c* and inner core edge 36*c*. The top surface 32 is also curved between edge 42*d*, over curved wall 46*d* and down to core edge 36*d*. The curvature created along top surface 32 allows for proper lordosis 6 of the neck 4 and spine 2 of the individual when the core 26 is used with cover 28 and the individual's head is placed in the area 44. As the central depression 40 is also present on the bottom surface 34, those in the art understand that there is a curvature created along bottom surface 34 as well with likewise curved walls on the bottom surface extending from the depression 40 to outer edges along the bottom surface. The curvature created along bottom surface 32 also allows for proper lordosis 6 of the neck 4 and spine 2 of the individual, so that the core 26 and pillow is reversible.

Figure 5:
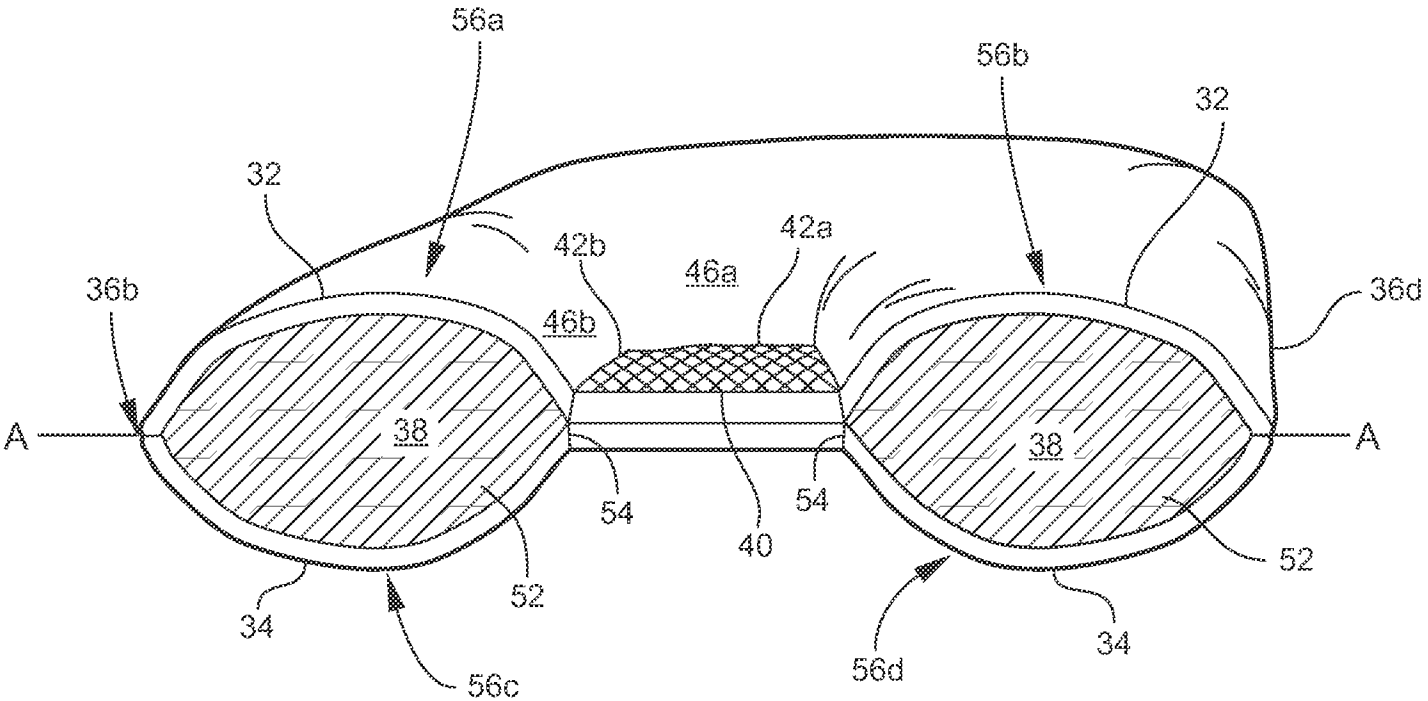
FIG. 5 is a cross section of the inner core of the pillow of the present invention along line A-A of FIG. 4.

FIG. 5 illustrates a cross section of the inner core insert 26 for pillow 24 of the present invention taken along the line A-A of FIG. 4. The cross section 50 illustrates a central pocket 38 and the fill material 52 inside the inner core insert piece 26 for pillow 24 of the present invention. The central pocket 38 is formed by the top surface material 32 fastened to the bottom surface material 34 along edges 36*a*-*d*. The fill material 52 inside central pocket is a polyester fill fiber material (e.g. Poly-Fil® made by Fairfield Processing Corp.) or suitable alternative which provides firmness and support, such as buckwheat seeds, solid foam, cotton fiber, wool fiber, or foam pieces. Note that the fill material does not enter into central depression region 40 thereby maintaining the reduced height and thickness in the central depression region 40 to create the curvature of the insert's surfaces 32 and 34. The fill material is packed moderately firm into the pocket area 38 so as to hold the weight of an individual's head without too much deformation of shape of the pillow 24 as a head weighs generally between 8-12 lbs. The amount of fill material may vary based on the particular fill used, but more than 15 ounces of polyester fiber fill should be used with a range of approximately 15-35 ounces depending on the core dimensions.

The curvature on the surfaces 32 and 34 form two neck support areas on the top 32 of the insert 26, indicated by 56*a* and 56*b*, and two neck support areas on bottom 34 of the insert, indicated as 56*c* and 56*d*. The multiple neck support areas 56(*a*-*d*) make the insert reversible (i.e. flipping insert 26 over to switch top 32 and bottom 34) and rotatable (i.e. placing pillow insert 26 into the case in either direction). The same neck support and proper lordosis is provided for an individual by the insert 26 and pillow 24 regardless of which side of the pillow 24 an individual rests his or her head.

The pillow inner core section 26 of the present invention may be made in the following manner. Two pieces of fabric which form the top surface 32 and bottom surface 34 are sewn together first around the circumference, and edges 36*a*-36*d*, leaving several inches unstitched. The fabric is then turned inside out, and the center depression 40 is sewn as indicated by reference numerals 54 in FIG. 5. The central depression area 40 therefore may be flexible and may have a thickness of just the two pieces of fabric sewn together. Those of skill in the art would recognize that the central depression region 40 may also be slightly filled or have a firmer piece inserted to increase rigidity or thickness of the central depression area 44 slightly. As an alternative, those skilled in the art would recognize that the central depression area 40 may even be cut out once the pocket of the inner core receives the fill material. It should also be noted that central depression 40 can be sewn in a shape other than square or rectangle, i.e. circles, ellipses, triangles, patterns, as long as there is sufficient area 44 in depression 40 to rest an individual's head. The inner core insert piece 26 is then stuffed with fill material through the unstitched area which is then stitched closed after being filled. Those of skill in the art would recognize that other methods of making pillows could be encompassed in the manufacture of the present invention as well and are considered to be within the scope of the present invention.

Figure 3A:
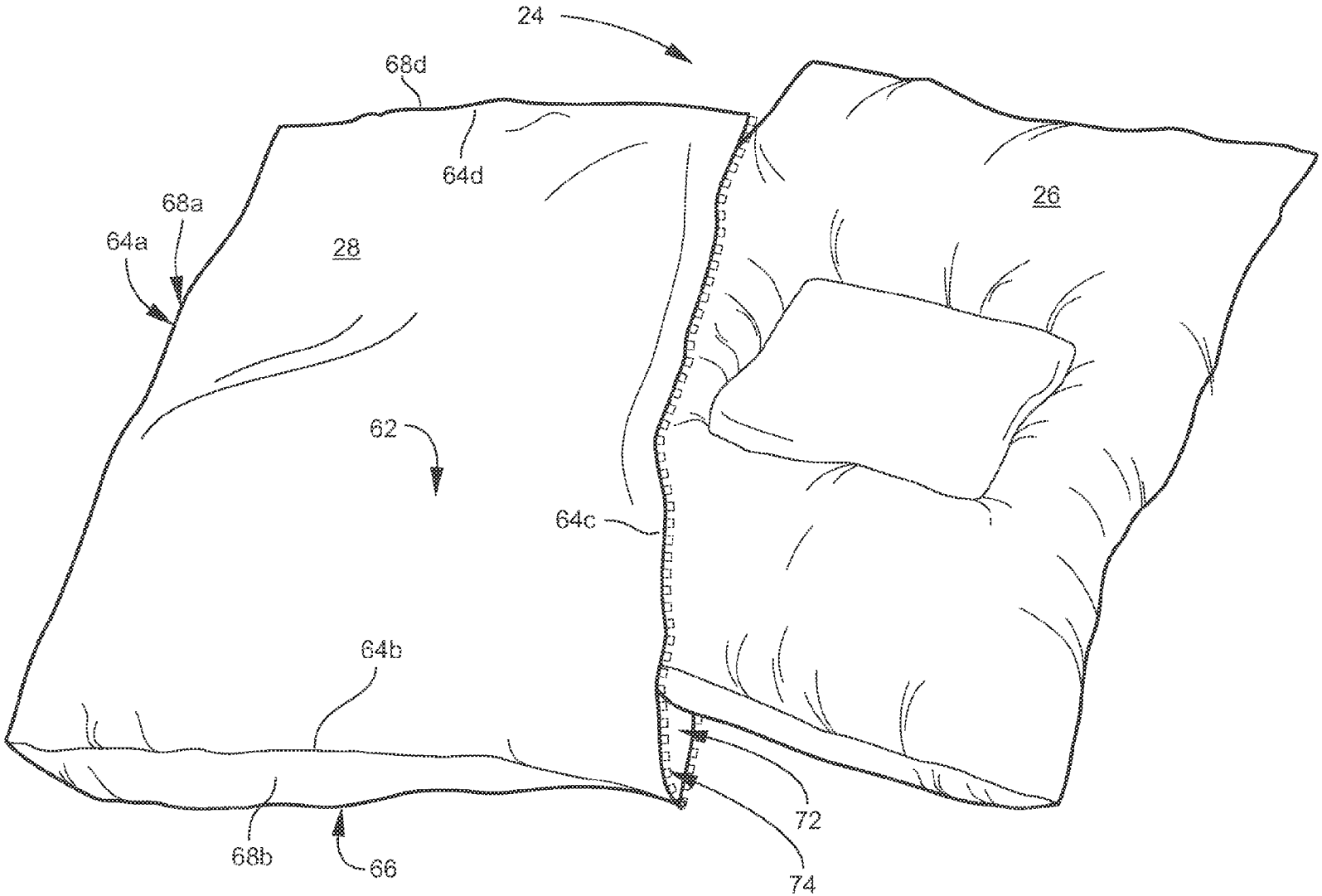
FIG. 3A is an illustration of the present invention.

Referring again now to FIG. 3A, there is shown an illustration of the pillow 24 with the pillow cover 28 as the pillow inner core section 26 is inserted into the pillow cover 28. The pillow cover 28 includes a top piece 62 with edges 64*a*, 64*b*, 64*c*, and 64*d*, and a bottom piece 66 with edges 68*a*, 68*b*, 68*c*, and 68*d*. The pillow cover 28 also has edges of the case which are sewn or secured by fastening top piece 62 to bottom piece 66. Together these pieces and edges form internal pocket 72 after three sets of corresponding top and bottom edges 64, 68 are fastened or sewn together. This allows for an opening 74 to insert the inner core piece 26 and thereby form support pillow 24. As shown in FIG. 3A, after top edges 64*a*, 64*b*, and 64*d* are fastened to their corresponding bottom edges 68*a*, 68*b*, and 68*d*, the top edge 64*c* and corresponding bottom edge 68*c* are left unfastened to create the opening 74 to insert the inner core piece 26. Once the inner core piece 26 is inserted into pocket 72, the opening 74 is fastened shut by known means such as zippers, buttons, snaps, ties, string, hook and loops connectors (such as Velcro), sewing, clips, adhesives etc. The opening 74 may also be formed between corresponding side edges, such as edges 64*b* and 68*b*, as an alternative that those skilled in the art would recognize, by first fastening the other corresponding edges 64*a*, 64*c*, 64*d* with 68*a*, 68*c*, and 68*d*. The inner core piece 26 is then inserted into pocket 72 through the opening 74 formed by the shorter side edges 64*b* and 68*b*, and then the cover 28 is fastened by similar means. (This is indicated by the embodiment shown in FIG. 3B.). The pillow cover 28 is filled with a filler selected from down/down feather fill, down alternative fiber in free form, down alternative webbing/netting, or combinations of the aforementioned, or other suitable alternatives to provide a soft, comfortable feel for the individual user.

Figure 6A:
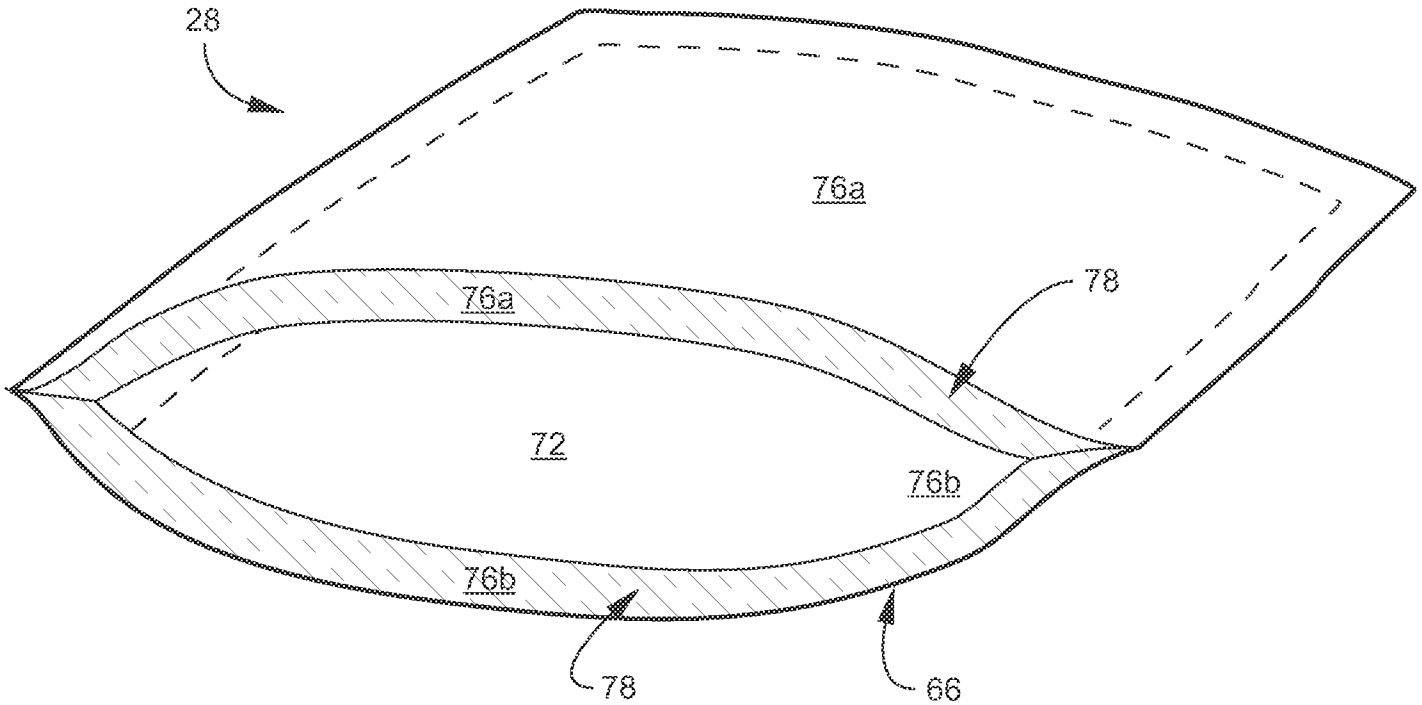
FIG. 6A is a cross section of the cover of the present invention.

As seen in FIG. 6A, the cross section of the pillow case 28 is illustrated with the filled pockets 76*a* and 76*b* which provide the additional comfort for the individual. The filled pockets 76*a* and 76*b* form the internal case pocket 72 which receives the core insert piece 26. The fill material 78 is selected from down or down alternative, such as a non-integral poly-fill fiber material and is placed into each of the pockets 76*a* and 76*b*. The fill material 78 may be selected from down/down feather fill, down alternative fiber in free form, down alternative webbing/netting, or combinations of the aforementioned, or other suitable alternatives.

The pillow cover or encasement 28 is made using two long pieces of fabric 62 and 66 which are sewn together along the outer edges (64*b*, 64*d* and 68*b*, 68*d*). The sewing may be done by machine or hand. This is then turned inside out. A line of stitching is then made down the center. The cover is then folded along that line of stitching, sewn up the sides and a fastener, such as a zipper attached along the top or a side edge. There are two pockets 76*a* and 76*b* produced by this stitching, which are filled with down or down alternative, down/down feather fill, down alternative fiber (free form), down alternative webbing/netting, or combinations of the aforementioned 78 and then sewn closed. A total of approximately 1-3 ounces of fill may be used for the two pockets, but other amounts may be used depending on the dimensions. The pillow insert will be placed inside the case 28 and the zipper secure. An alternative method of making the cover piece is described later with respect to FIG. 11.

Figure 6B:
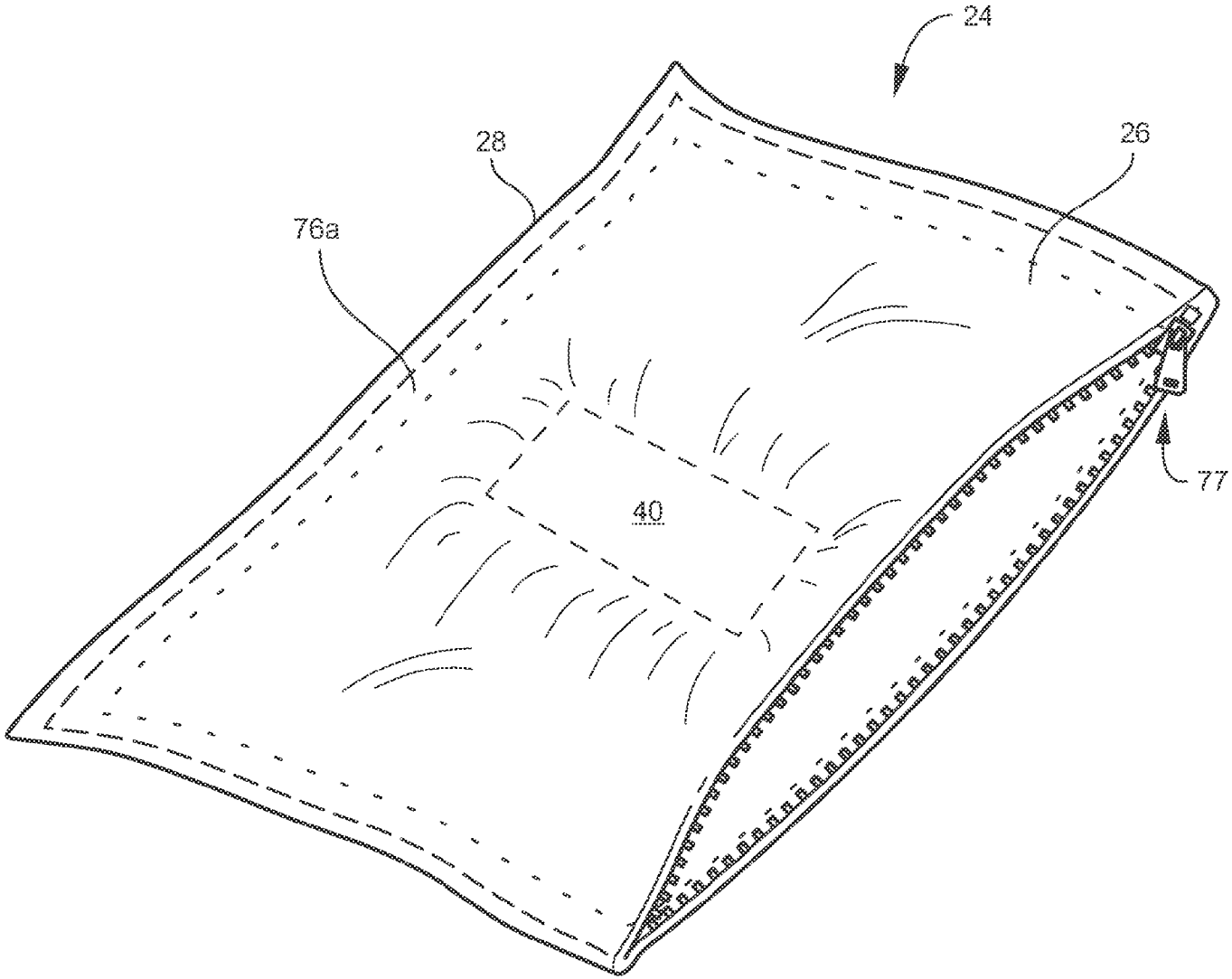
FIG. 6B is an illustration of the present invention with the back sleeper insert inside the cover.

FIG. 6B is an illustration of the pillow of the present invention 24 with the back sleeper insert piece 26 placed inside the pillow case 28. Both components are shown as they fit together in the final product. The firmer insert piece 26 is placed into the internal case pocket 72 and between the softer down filled/down alternative filled pockets 76*a* and 76*b*. The user receives the comfort and feel of their favorite down/down alternative pillow, yet the central depression 40 of the firmer back sleeper insert provides support for the neck. As discussed with respect to FIG. 3B previously, in an embodiment of the invention, the insert piece 26 can be placed inside the pillow case 28 along the shorter side.

Figure 7:
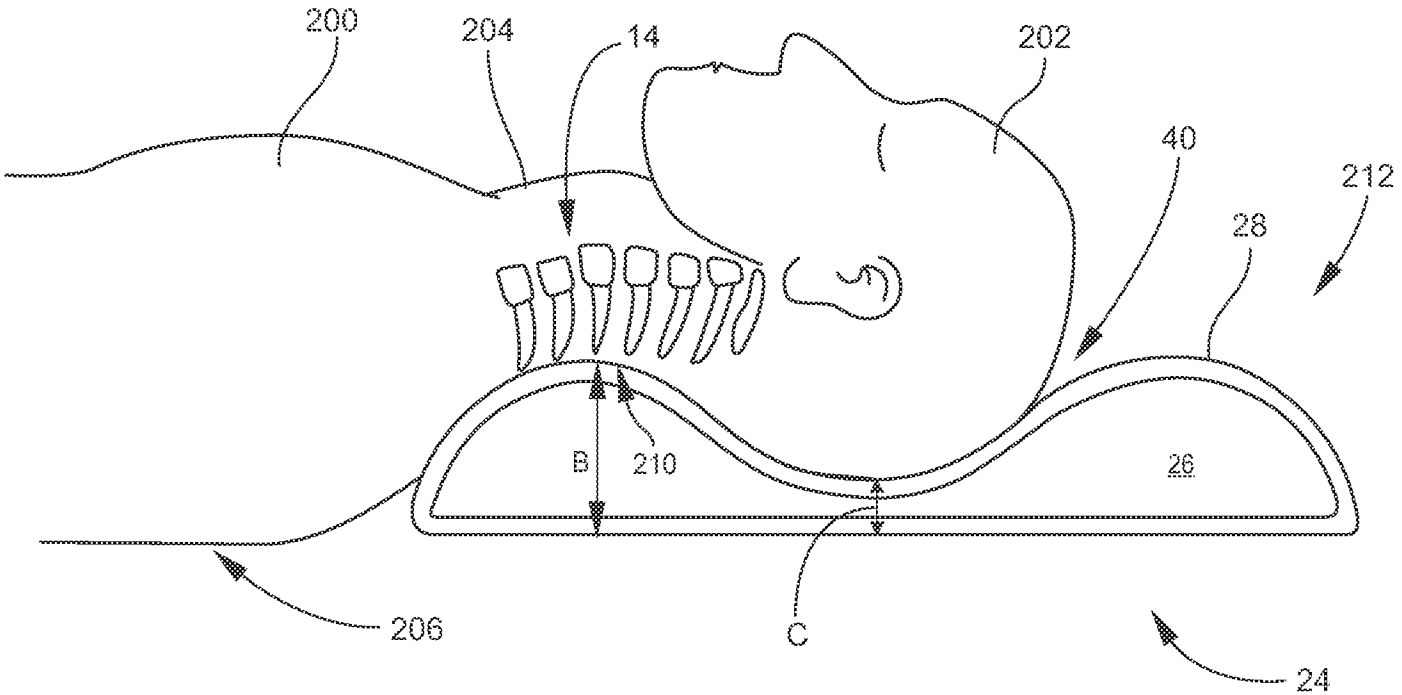
FIG. 7 illustrates the pillow of the present invention in use for a back sleeper.

As seen in FIGS. 3, 5, and 7, the back and back/side combo sleeper just described uses the pillow insert 26 with a central depression. It should be noted that there is a curved support 210 for under the neck while back sleeping, that supports the normal cervical curve or lordosis 6. The normal lordosis, in anatomically correct models, is approximately an average of 35-45 degrees as noted above in Table 1. The pillow 24 is shaped in a curved fashion along the bottom and top of the pillow so as to properly support the lordosis 6 as best as possible within the range of 35 to 45 degrees. The central rectangular depression 40 does not have any or any significant fill material so that the back of the head 6 is at nearly the same plane as the back of the body, in an attempt to be as anatomically correct as possible. The rectangular depression 40 is somewhat narrow, only approximately 5 to 7 inches so that while sleeping in the supine position, the sleeper is prevented from fully turning the head. This is so the head 9 and neck 4 are supported in as close to an anatomically neutral position as possible. The lordosis and cervical curve and the rounded supports 210 and 212 on the top and bottom of the back/side sleeper pillow 24 should have approximately a 40 degree curve to it, including the down/alternative encasement 28. The pocket of this insert 26 is filled to measure approximately 4 to 4½ inches, for the average sized person. Various other sizes, such as a "petite" and a larger or extra-large or travel size version of this insert can be made as well.

The alignment of the spine described above is shown in FIG. 7, where the pillow inner core 26 for the pillow 24 is in use by the individual 200 who is a back sleeper and rests his/her head 202 on the pillow 24 with the cover 28. In this instance, the individual 200 rests their back 206 flat when they sleep or lie down so that cervical spine 14 of the individual 200 is aligned as shown. The cervical spine 14 aligns correctly in this manner because the individual 200 places his/her head 202 in the central depression 40 of the pillow 24 from inner core 26. As the thickness and height B of the pillow 24 of the present invention is greater under the neck 204 of the individual 200 than the thickness and height C of the central depression 40, the proper curvature of the cervical spine 14 is supported at the appropriate angle of 35 to 45 degrees.

Figure 8A:
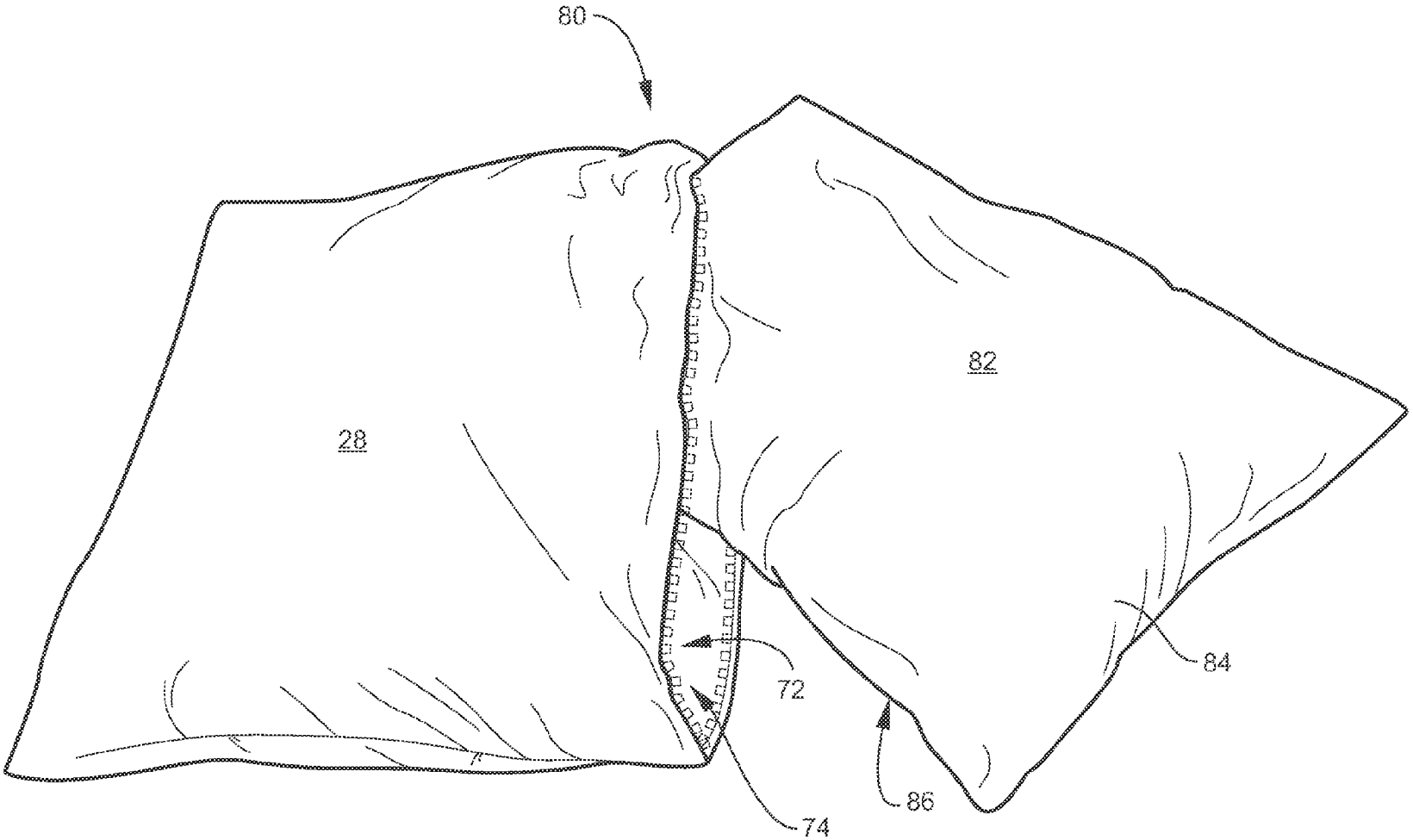
FIG. 8A is the side sleeper inner core of the present invention inserted into a cover.
Figure 8B:
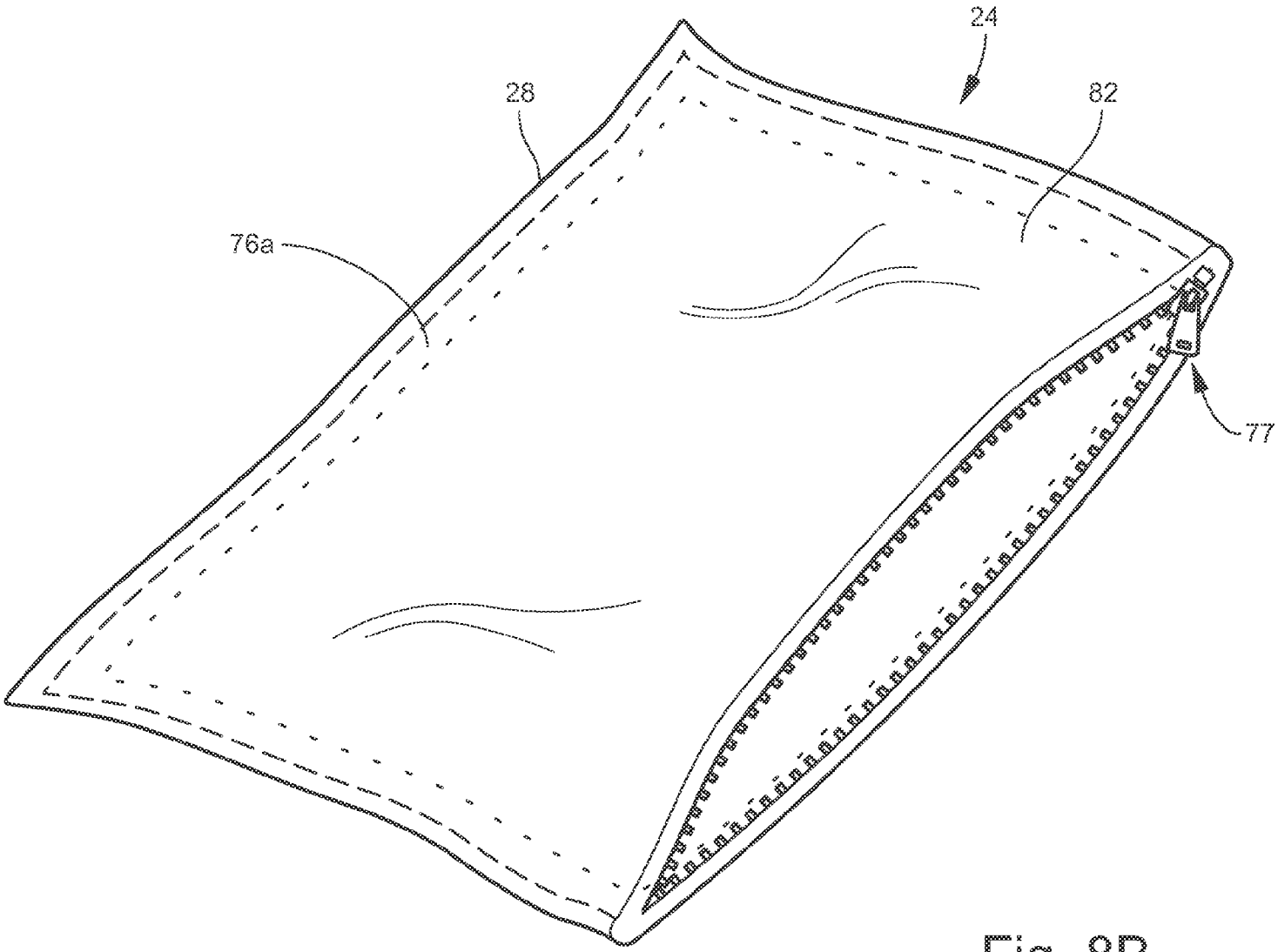
FIG. 8B is an illustration of the present invention with the side sleeper inner core inside the cover.
Figure 8C:
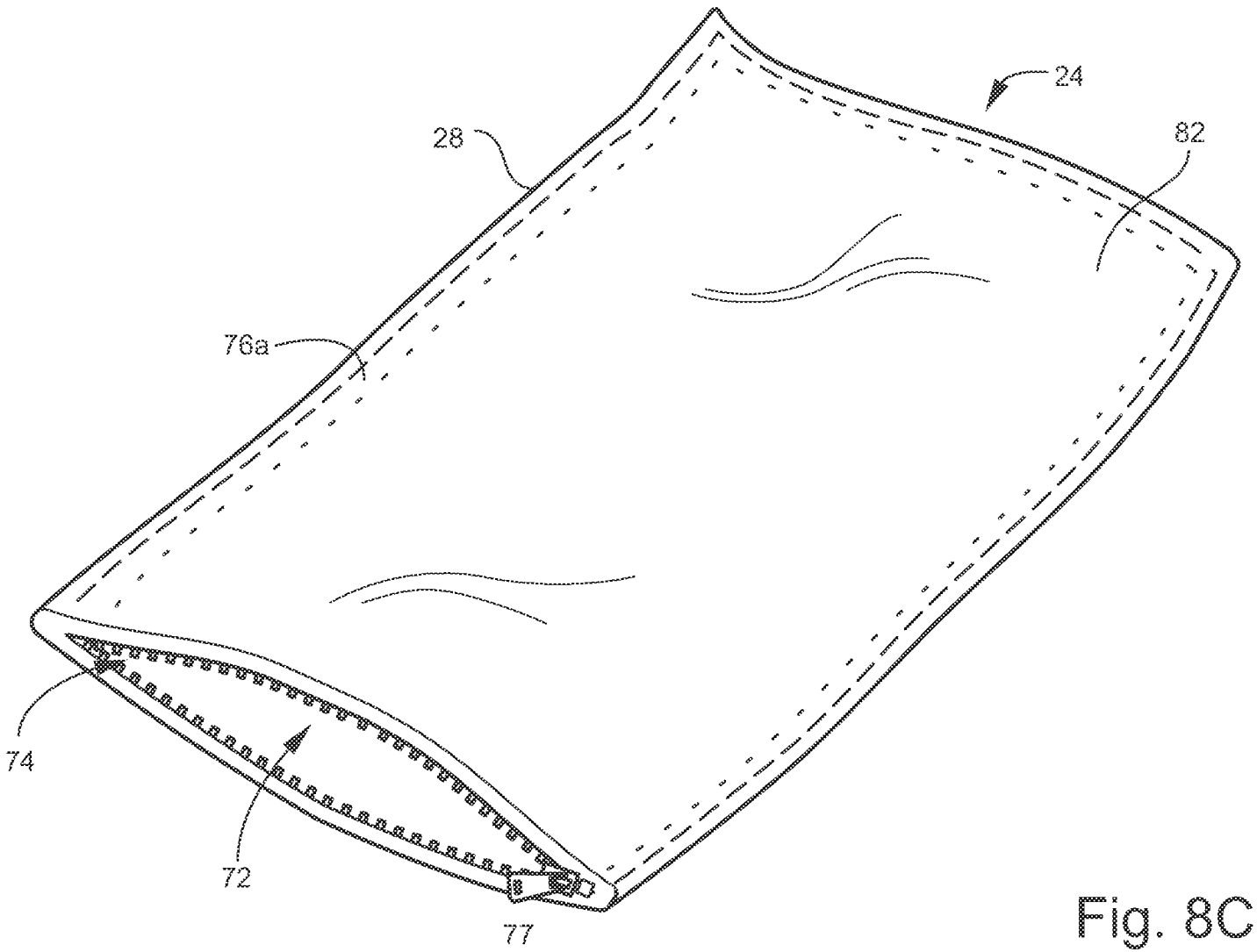
FIG. 8C is an embodiment of the side sleeper with a side insert opening.

Referring to FIGS. 8A and 8B, there is shown an embodiment of the side sleeper pillow 80 of the present invention. As seen in FIG. 8A, the inner core is again inserted into pillow cover 28 by opening 74 and into the internal pocket 72. The pillow case 28 and side sleeper pillow insert 82 may then be secured inside the internal pocket 72 by means known in the art such as zippers, buttons, and other fastening mechanisms 77. As discussed previously with FIG. 3B, the opening 74 in FIGS. 8A and 8B, may also be formed on a shorter side edge 64*b*, 68*b* with the fastening mechanism 77 located on that side edge 64*b*, 68*b*. This is illustrated with FIG. 8C.

The side sleeper insert 82 has a top surface 84 and bottom surface 86. Similar to before, the side sleeper insert 82 is formed by fabric sewn or (folded and sewn) to create a pocket 88. The pocket 88 is filled with polyester fiber-fill material 52 or suitable alternative. (poly-fill is indicated by hash lines in FIG. 9). When inserted into the pillow cover 28, the side sleeper insert 82 is encased by the soft down/down alternative filled pockets 76*a* and 76*b* of the cover to provide comfort over the firmer inner core 82. Together the cover 28 and the insert 82 form the side sleeper pillow.

Figure 9:
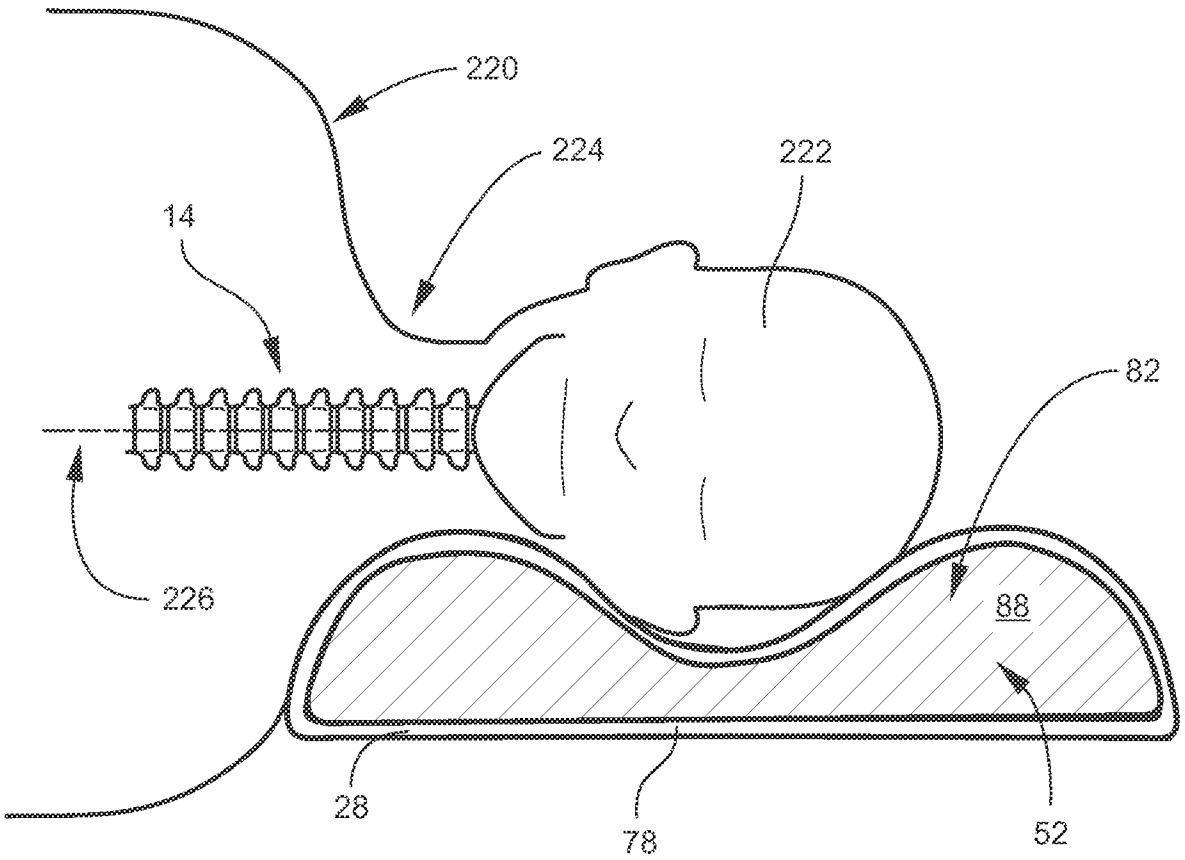
FIG. 9 illustrates the pillow of the present invention in use for a side sleeper.

With respect to FIG. 9, there is shown a side sleeper individual 220 with head 222 and neck 224 aligned as shown so that cervical spine 14 aligns properly. The side sleeper version of the pillow insert 82 is intended to support the head in a neutral position while side lying, meaning that the head neither tilts upward or downward and the spine remains in a straight line in the saggital plane 226. This means that when the head is placed on the pillow while in the side sleeping position, it slightly depresses the thickness of the pillow due to the weight of the head. The thickness of the pillow must take this into account and so must support the head in its proper alignment. The average distance measured from the side of the head to the side of the shoulder/arm is about 5-6 inches and so the pillow will measure approximately 6 inches in height in order to maintain proper support and alignment when the weight of the head is placed upon it. Thus, the pillow has an insert with a thickness of 4 inches, and the down/down-alternative encasement 28 makes the remainder of that measurement (approximately 2 inches) in the final product. "Petite" and "XL" versions of this side sleeper insert 82 are designed to accommodate various body sizes, and they will measure approximately 3 and 5 inches in thickness respectively.

Example

In a particular non-limiting example as illustrated by reference to FIGS. 3A and 3B, the back sleeper pillow insert is 20 inches×28 inches×6 inches in size and should fit in any standard pillowcase. The side sleeper pillow (FIG. 8A) has an inner core insert 84 that is rectangular in shape and measures 18 inches×26 inches×4 inches.

Figure 3B:
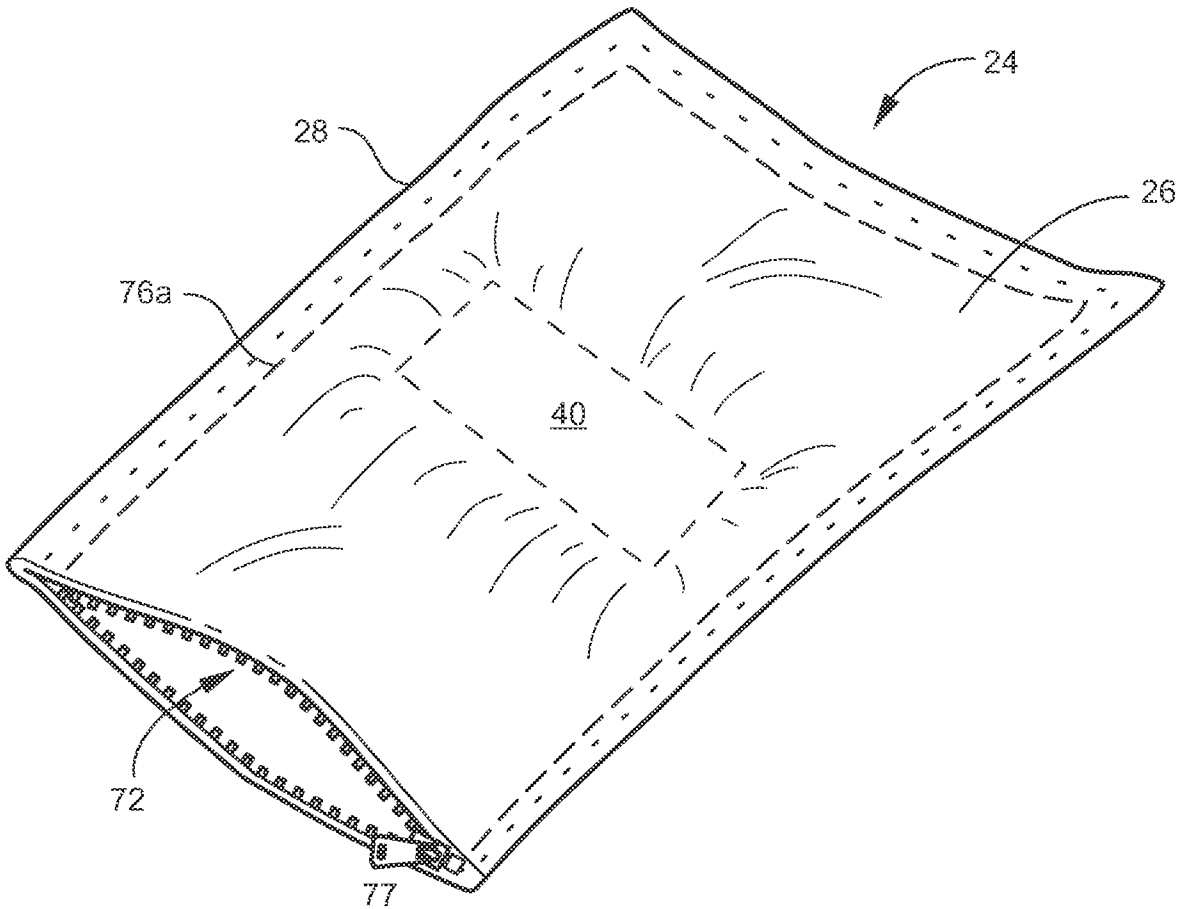
FIG. 3B is an illustration of an embodiment of the present invention.

The embodiment of the back/side combination sleeper pillow 24 in FIGS. 3A and 3B has an inner core insert 26 that is rectangular in shape and measures 18 inches×26 inches×4 inches. There is a depression 40 in the center that is generally rectangular in shape and spans the pillow height (top to bottom) from the distance of 5 inches to 13 inches, for a depression of approximately 8 inches top to bottom. The depression is at the measurements of approximately 10 inches to 16 inches along the length (side to side) of the pillow, for a total of 6 inches. This depression 40 is to be stitched down so that the polyester fiber fill material in the insert creates two neck/cervical spine supports 210 and 212 for back sleeping on the top surface 32 of the pillow 24 and insert 26. The stitched rectangular depression has slightly rounded corners 41 to relieve tension of the pillow material. The core insert 26 is reversible.

A cover 28 shown in FIG. 6A has 20 inch by 28 inch finished measurements. The cover has two pockets 76*a* and 76*b* on either side of the cover 28 and secured with a zipper along the top or along the side, although other fasteners may be used as well. The two pockets 76*a* and 76*b* are filled with either down or down alternative 78, each measuring 1 inch thick. This outer cover layer 28 provides the comfort, and a soft fluffy feel to the pillow for a restful slumber.

Figure 10:
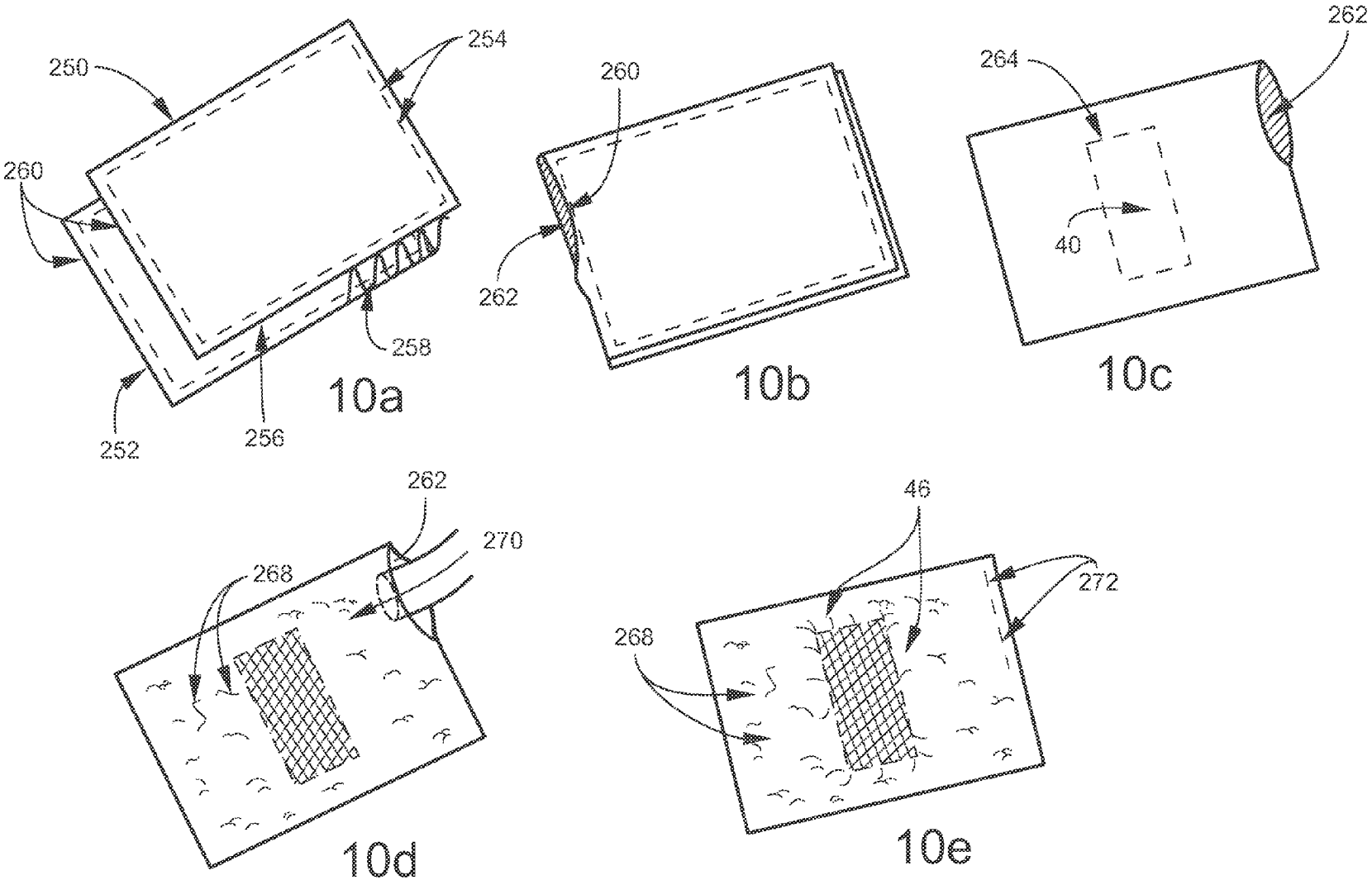
FIG. 10 illustrates a method of making the inner core of the back/side sleeper pillow of the present invention.

Referring now to FIG. 10, there is shown a particular method of making the inner core piece for the present invention with steps 10*a*. through 10*e*. In step 10*a*., there are shown two pieces of fabric 250, 252 which are (approximately) identical in dimensions. The first piece of fabric 250 is placed parallel and on top of the second piece of fabric 252, which are then sewn or stitched together around or near their perimeters 254 with appropriate known stitching techniques to create a pocket 256 between the two layers of fabric 250, 252. Hand sewing may be used, along with various known threads 258. The first and second pieces, however, are not completely sewn together, as a section of the fabric remains unstitched 260. This is illustrated in step 10*b*, where the two pieces of fabric 250, 252 have been substantially sewn together but an unstitched section 260 forms an opening 262 between the two pieces 250, 252. The combined fabric is then turned inside out by pulling the fastened fabric pieces through the opening 262. The result is illustrated in step 10*c*., where the opening 262 is now positioned at an opposite corner. In step 10*c*., the central depression area 40 is formed by sewing a section 264 in an appropriate size for an individual's head as discussed previously. In step 10*d*., the fill material 268 is inserted into the opening 262 between the two pieces of fabric, thereby filling up the volume of the pocket formed by and contained between the two pieces of fabric. Approximately 20-25 ounces of polyester fiber fill (Poly-Fil®) is used in this example. The fill material, however, does not enter into the central depression area as this has been stitched closed in the previous step. After sufficient volume of fill has been added to substantially or fully pack the inner core piece and form the walls 46 which extend upward from the central depression, the opening is stitched closed 272. This is illustrated in step 10*e*.

Figure 11:
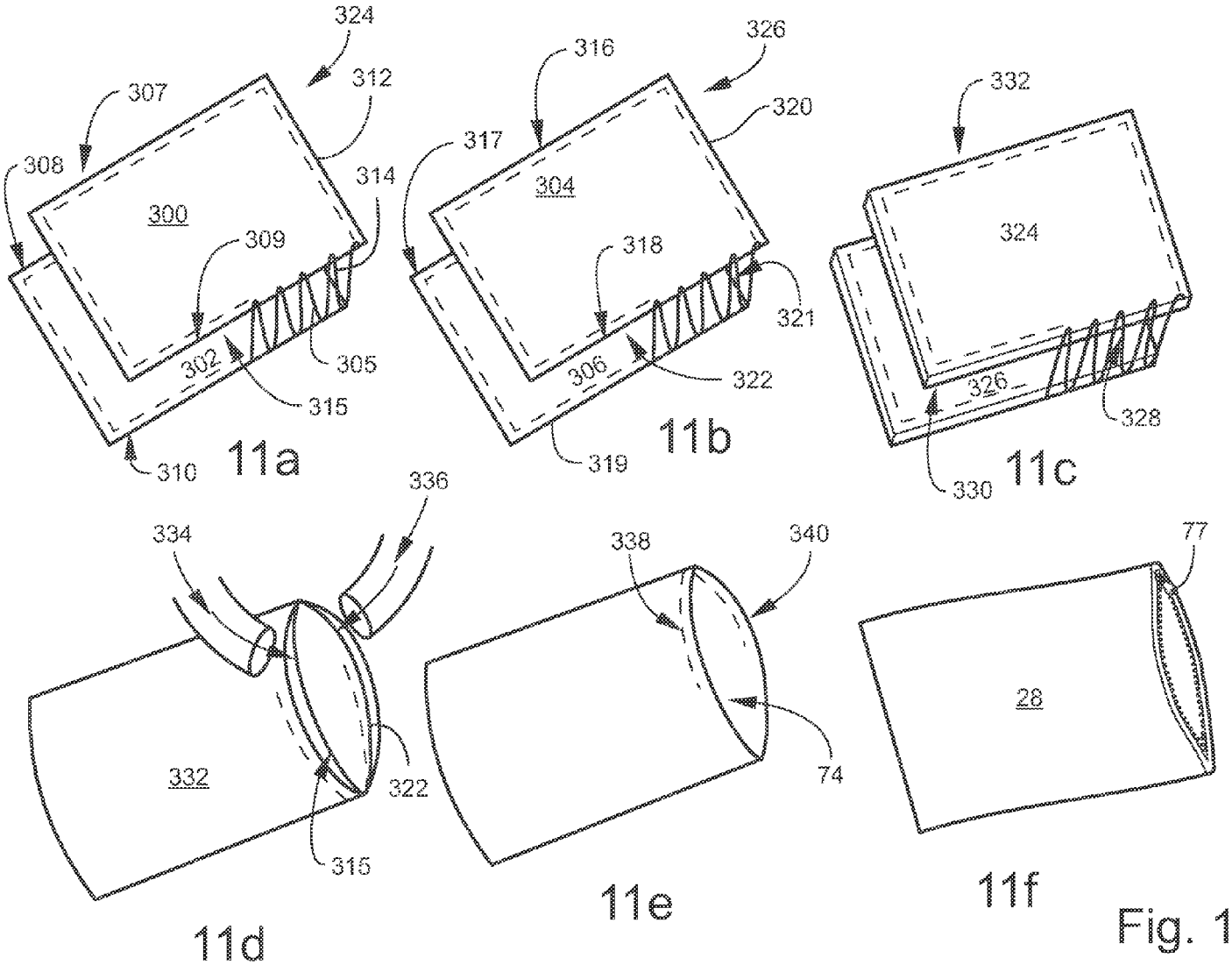
FIG. 11 illustrates a method of making the encasement of the present invention.

With reference to FIG. 11, a particular method of making the pillow encasement is described. First, four pieces of fabric (300, 302, 304, 306) are cut to measure 21¼"×29¼" and a ⅝" seam allowance is cut from each side, so the final fabric dimensions are 20"×28." The fabric may be an organic cotton fabric. Next, two pieces of the fabric (300, 302) are sewn 305 with surfaces together on both long sides (307, 308, and 309, 310) and one short side (312, 314) to form a pocket 315 and the top piece 324. (Step 11*a*.) This is then repeated with the second pair of fabric pieces (304, 306) which are sewn along long sides (316, 317 and 318, 319), and a short side (320, 321) to form a pocket 322 and the bottom piece 326. (Step 11*b*.) The two pairs of fabric, that is the top and bottom pieces 324, 326, are then again sewn together 328 on the same three sides which were sewed in steps 11*a*. and 11*b*. to form pocket 330 and the unfilled encasement 332 (Step 11*c*.). After this step, the unfilled encasement 332 is turned inside out and the two pockets 315, 322 created in the two pillow surfaces 324, 326 are filled (334, 336) with down or down alternative, down/feather combination, down alternative fiber (free form), down alternative webbing/netting, or combinations of the aforementioned (Step 11*d*). A total of approximately 2 ounces of fill are used for the pockets 315, 322. The remaining short side of the top pocket 315 is stitched/fastened 338 and this is repeated for the bottom pocket 322 with stitching/fastening 340 to secure the fill within the pockets 315, 322 (Step 11*e*). A zipper or fastener 77 is installed along the open short end of the final encasement 28 piece (Step 11*f*). The encasement 28 is now prepared to receive through the open end 74 an inner core piece, such as that described in this Example.

By combining the firmer inner core support for the head and/or neck with an outer layer for increased comfort, the support pillow of the present invention can be used by either back or side sleepers for both ideal support and maximum comfort.

What is claimed is:

1. An inner core for a pillow, said inner core comprising:

a top surface section with outer edges and an interior area;

a bottom surface section with outer edges and an interior area; said top surface section outer edges fastened to said bottom surface section outer edges, forming a pocket;

said top surface section and said bottom surface section fastened together at said interior areas, forming a depressed area with a surface having a surface area of approximately 40 square inches to approximately 56 square inches for receiving an individual's head in said depressed area surface;

said pocket containing a fill material, but excluding said depressed area, said pocket filled to a thickness of approximately four to four and ½ inches with said fill material;

said fill material selected from the group comprising polyester fiber fill, buckwheat seeds, solid foam, cotton fiber, wool fiber, or foam pieces or combinations thereof;

at least one wall extending upward from said depressed area to said outer edges of said top surface section, thereby forming at least one curved neck support area on said top surface section;

said at least one curved neck support area on said top surface section having a width of approximately five inches from said outer edges of said top surface section to said depressed area; and said at least one curved neck support area having a curvature which supports a lordosis curvature of 35 to 45 degrees to the individual.

2. The inner core of claim 1 wherein the fill material is a polyester fiber fill material.

3. The inner core of claim 1 wherein said at least one curved neck support area has a width of approximately 5 inches to approximately 6 inches.

4. A support pillow comprising:

an outer case having first and second sections; said first and said second sections fastened together to form an interior opening to receive an inner core; a pocket in at least one of said first or second sections containing a first fill material;

said inner core having a top surface section with outer edges and an interior area; a bottom surface section with outer edges and an interior area; said top surface section outer edges fastened to said bottom surface section outer edges, forming an inner core pocket;

said top surface section and said bottom surface section fastened together at said interior areas, forming a depressed area with a surface having surface area of approximately 40 square inches to approximately 56 square inches for receiving an individual's head in said depressed area surface;

said inner core pocket containing a second fill material, but excluding said depressed area; said pocket inner core filled to a thickness of approximately four to four and ½ inches with said second fill material; said second fill material selected from the group comprising polyester fiber fill, buckwheat seeds, solid foam, cotton fiber, wool fiber, or foam pieces or combinations thereof;

at least one wall extending upward from said depressed area to said outer edges of said top surface section, thereby forming at least one curved neck support area on said top surface section;

said at least one curved neck support area on said top surface section having a width of approximately five inches from said outer edges of said top surface section to said depressed area; and said at least one curved neck support area having a curvature which combines with said outer case to support[s] a lordosis curvature of 35 to 45 degrees to the individual; and said inner core firmer relative to said outer case.

5. The support pillow of claim 4 wherein said first fill material for said pocket of the outer case is selected from the group comprising down, down/feather combination, down alternative, down alternative fiber in free form, down alternative webbing, down alternative netting, or combinations thereof.

6. The support pillow of claim 4 wherein said second fill material is a polyester fiber fill material.

7. The support pillow of claim 4 wherein said outer case and said inner core pocket have a total thickness of approximately six inches.

8. The support pillow of claim 4 wherein said first and said second sections of said outer case each have a thickness of approximately one inch when filled with said first fill material.

9. The support pillow of claim 4 wherein said at least one curved neck support area has a width of approximately 5 inches to approximately 6 inches.

10. A reversible support pillow comprising:

an outer case having first and second sections; said first and said second sections fastened together to form an interior opening to receive an inner core;

a pocket in each of said first and second sections containing a first fill material;

said first fill material selected from the group comprising down, down/feather combination, down alternative, down alternative fiber in free form, down alternative webbing, down alternative netting, or combinations thereof;

said inner core having a top surface section with outer edges and an interior area; a bottom surface section with outer edges and an interior area; said top surface section outer edges fastened to said bottom surface section outer edges, forming an inner core pocket;

said top surface section and said bottom surface section fastened together at said interior areas, forming a depressed area in each of said top surface and bottom surface sections, each of said top surface section and bottom surface section depressed areas having a surface of approximately forty square inches to approximately fifty-six square inches for receiving an individual's head on said depressed areas surfaces;

said inner core pocket containing a polyester fiber fill material, but excluding said depressed area;

said inner core pocket filled to a thickness of approximately four to four and ½ inches with said polyester fiber fill material;

at least one wall extending upward from said top surface section depressed area to said outer edges of said top surface section, thereby forming at least one curved neck support area on said top surface section; said at least one curved neck support area on said top surface section having a width of approximately five inches from said outer edges of said top surface section to said top surface section depressed area;

said at least one curved neck support area on said top surface having a curvature which combines with said outer case to support a lordosis curvature of 35 to 45 degrees to the individual;

at least one wall extending from said bottom surface section depressed area to said outer edges of said bottom surface section, thereby forming at least one curved neck support area on said bottom surface section; said at least one curved neck support area on said bottom surface section having a width of approximately five inches from said outer edges of said bottom surface section to said bottom surface section depressed area;

said at least one curved neck support area on said bottom surface section having a curvature which combines with said outer case to support a lordosis curvature of 35 to 45 degrees to the individual; and said inner, core firmer relative to said outer case.

11. The reversible support pillow of claim 10 wherein said first and said second sections of said outer case each have a thickness of approximately one inch when filled with said first fill material.

12. The reversible support pillow of claim 10 wherein said outer case and said inner core pocket have a total thickness of approximately six inches.

13. The reversible support pillow of claim 10 wherein said at least one curved neck support area has a width of approximately 5 inches to approximately 6 inches.

* * * * *